US010250961B2

(12) United States Patent
Zhang et al.

(10) Patent No.: US 10,250,961 B2
(45) Date of Patent: Apr. 2, 2019

(54) SPEAKER MODULE

(71) Applicant: Goertek.Inc, Shandong (CN)

(72) Inventors: Zhibing Zhang, Shandong (CN); Gang Chen, Shandong (CN)

(73) Assignee: GOERTEK INC., Shandong (CN)

( * ) Notice: Subject to any disclaimer, the term of this patent is extended or adjusted under 35 U.S.C. 154(b) by 18 days.

(21) Appl. No.: 15/570,542

(22) PCT Filed: Dec. 14, 2015

(86) PCT No.: PCT/CN2015/097316
§ 371 (c)(1),
(2) Date: Oct. 30, 2017

(87) PCT Pub. No.: WO2016/176997
PCT Pub. Date: Nov. 10, 2016

(65) Prior Publication Data

US 2018/0152773 A1 May 31, 2018

(30) Foreign Application Priority Data

May 4, 2015 (CN) ..... 2015 1 0221328

(51) Int. Cl.
*H04R 9/00* (2006.01)
*H04R 1/02* (2006.01)
(Continued)

(52) U.S. Cl.
CPC ..... *H04R 1/025* (2013.01); *H04R 9/025* (2013.01); *H04R 9/045* (2013.01); *H04R 9/046* (2013.01);
(Continued)

(58) Field of Classification Search
CPC ..... H04R 9/00; H04R 9/048; H04R 29/003; H04R 2209/00; H04R 2209/41
(Continued)

(56) References Cited

U.S. PATENT DOCUMENTS 4,160,133 A * 7/1979 Wiik ..... H04R 9/02 381/401
4,609,784 A * 9/1986 Miller ..... H04R 3/002 381/401
(Continued)

FOREIGN PATENT DOCUMENTS

CN 201585122 U 9/2010
CN 102065359 A 5/2011
(Continued)

OTHER PUBLICATIONS

International Search Report and Written Opinion from International Application No. PCT/CN2015/097316, dated Mar. 14, 2016, 8 pages.

*Primary Examiner* — Suhan Ni
(74) *Attorney, Agent, or Firm* — Alston & Bird LLP

(57) ABSTRACT

A speaker module is disclosed, which comprises an inner cavity defined by a shell, and a magnetic circuit system and a vibrating system arranged inside the inner cavity, wherein the vibrating system comprises a vibrating diaphragm fixed in the inner cavity, a voice coil is fixed to a lower end of the vibrating diaphragm, a first induction coil is provided to an upper end of the vibrating diaphragm, the voice coil is electrically connected with the first induction coil via its down-lead, and a second induction coil is provided above the first induction coil for electrically connecting a terminal device. When the speaker module operates, the terminal device conducts a current signal of an external audio to the second induction coil, so that the second induction coil generates a magnetic field which changes along with the change of the audio signal current.

9 Claims, 2 Drawing Sheets

(51) Int. Cl.

| | |
|---|---|
| ***H04R 9/06*** | (2006.01) |
| ***H04R 9/02*** | (2006.01) |
| ***H04R 9/04*** | (2006.01) |
| *H04R 1/28* | (2006.01) |
| *H04R 1/22* | (2006.01) |

(52) U.S. Cl.
CPC ..... *H04R 9/06* (2013.01); *H04R 1/22* (2013.01); *H04R 1/2865* (2013.01); *H04R 2209/024* (2013.01); *H04R 2209/041* (2013.01); *H04R 2400/11* (2013.01); *H04R 2499/11* (2013.01)

(58) Field of Classification Search
USPC ..... 381/396, 399, 401, 402, 406
See application file for complete search history.

(56) References Cited

U.S. PATENT DOCUMENTS 6,373,958 B1 * 4/2002 Enomoto ..... B06B 1/0246 381/406
7,873,179 B2 * 1/2011 Takewa ..... H04R 7/18 381/400

FOREIGN PATENT DOCUMENTS

| | | | |
|---|---|---|---|
| CN | 104768109 | A | 7/2015 |
| CN | 104796828 | A | 7/2015 |
| CN | 204442659 | U | 7/2015 |
| CN | 204559870 | U | 8/2015 |
| JP | 2001-197579 | A | 7/2001 |
| WO | WO 2014/198958 | A2 | 12/2014 |

* cited by examiner

SPEAKER MODULE

CROSS-REFERENCE TO RELATED APPLICATIONS

This application is a National Stage Application, filed under 35 U.S.C. § 371, of International Application No. PCT/CN2015/097316, filed on Dec. 14, 2015, which international application claims priority to Chinese Patent Application No. 201510221328.0, filed on May 4, 2015, the contents of both of which as are hereby incorporated by reference in their entireties.

BACKGROUND

Related Field

The present invention relates to the field of sound generating devices, and in particular, to a speaker module.

Description of Related Art

A speaker as an important acoustic component in an electronic device is a transducer for converting an electrical signal into an acoustic signal. The existing speaker module comprises a shell, and a vibrating system and a magnetic circuit system provided inside the shell. The vibrating system comprises a vibrating diaphragm and a voice coil provided on the vibrating diaphragm and used for driving the vibrating diaphragm to generate a sound. The voice coil is connected with the system using a down-lead to achieve the circuit connectivity. In the prior art, according to the structure of a movable voice coil speaker, the electrical signal is transmitted to the voice coil, and then the voice coil drives the vibrating diaphragm to generate a sound signal. In the process of connecting the voice coil using electrical signals, the voice coil needs two down-leads to connect an FPCB, a cable or an elastic sheet or the like of the system. Such a structure is widely adopted by manufacturers due to the simple and mature manufacturing process. However, this structure also has some problems because of its structure (as the two down-leads vibrate along with the voice coil):

1. Structural makeup is required, which sacrifices the size of the magnetic circuit system; and
2. The down-leads can be easily broken, which generates an open circuit of the system to disable sound generation; and
3. Polarization will occur to the voice coil when the voice coil is vibrating due to pulling of the two down-leads, which causes poor performance.

BRIEF SUMMARY

The present invention is directed to a novel technical solution of a speaker module.

An embodiment of this disclosure provides a speaker module, comprising an inner cavity defined by a shell, and a magnetic circuit system and a vibrating system arranged inside the inner cavity, wherein the vibrating system comprises a vibrating diaphragm fixed in the inner cavity, a voice coil is fixed to a lower end of the vibrating diaphragm, a first induction coil is provided to an upper end of the vibrating diaphragm, the voice coil is electrically connected with the first induction coil via a down-lead of the voice coil, and a second induction coil is provided above the first induction coil for electrically connecting a terminal device.

Preferably, a first circuit board is provided between the first induction coil and the vibrating diaphragm; and the shell is provided with a second circuit board to whose lower end the second induction coil is fixed.

Preferably, the second circuit board is fixed at an outer side of the shell, and the shell is provided with a through-hole through which the second induction coil can reach the inner cavity.

Preferably, the first induction coil faces the second induction coil.

Preferably, magnetic conductive plates are provided on end surfaces, away from each other, of the first induction coil and the second induction coil, respectively.

Preferably, the vibrating diaphragm is provided with a through-hole through which the down-lead of the voice coil is electrically connected with the first induction coil.

Preferably, the through-hole is located at the middle of the vibrating diaphragm.

Preferably, the shell comprises an upper shell, an intermediate shell and a lower shell that are buckled together in sequence.

Preferably, a magnetic conductive column or magnetic conductive liquid is provided inside a through-hole of each of the first induction coil and the second induction coil.

Preferably, the first circuit board is an FPCB.

According to the speaker module of the present invention, the second induction coil is electrically connected with the terminal device, and the first induction coil is electrically connected with the voice coil. When operating, the terminal device conducts a current signal of an external audio to the second induction coil, so that the second induction coil generates a magnetic field which changes along with the change of the audio signal current. The first induction coil can induce the changing magnetic field. In other words, when the magnetic flux passing through a closed circuit changes, a changing current will be generated and is conducted to the voice coil. Then, the voice coil is driven to vibrate, and a sound generation of the speaker is achieved.

According to the speaker module of the present invention, through the first circuit board provided above the vibrating diaphragm, the first and second induction coils, the connection manner of traditional voice coil down-leads is changed, and much space is saved for the magnetic circuit system. That is, the magnetic circuit system can be made even larger to improve the sensitivity and the frequency response curve. According to the structure of the present invention, the down-leads of the voice coil are directly electrically connected with the first circuit board provided above the vibrating diaphragm and the first induction coil, so that the down-leads can vibrate along with the vibrating diaphragm. In this way, a material of the down-leads of the voice coil can be selected freely. A copper-coated aluminum down-lead or the like may be used. In addition, poor polarization caused by down-leads can be avoided. Further, in the present invention, the first circuit board provided at the upper end of the vibrating diaphragm, and the first induction coil can act as a spherical crown structure of the vibrating diaphragm, thereby improving the strength of the vibrating diaphragm at that position and changing the vibration frequency of the vibrating diaphragm.

The inventor of the preset invention finds that, in the prior art, the voice coil require two down-leads to connect with the FPCB, the cable, the elastic sheet or the like of the system so that resonance is caused and too much space is occupied. Therefore, the technical task to be achieved by the present invention or the technical problem to be solved by the present invention is an unintentional or unanticipated one for those skilled in the art, and accordingly, the present invention is a novel technical solution.

Other features and advantages of the present invention will become apparent from the following detailed description of exemplary embodiments of the present invention with reference to the accompanying drawings.

BRIEF DESCRIPTION OF THE FIGURES

The accompanying drawings, which are incorporated in and constitute a part of the description, illustrate embodiments of the present invention and, together with the description thereof, serve to explain the principles of the present invention.

DETAILED DESCRIPTION OF VARIOUS EMBODIMENTS

Figure 1:
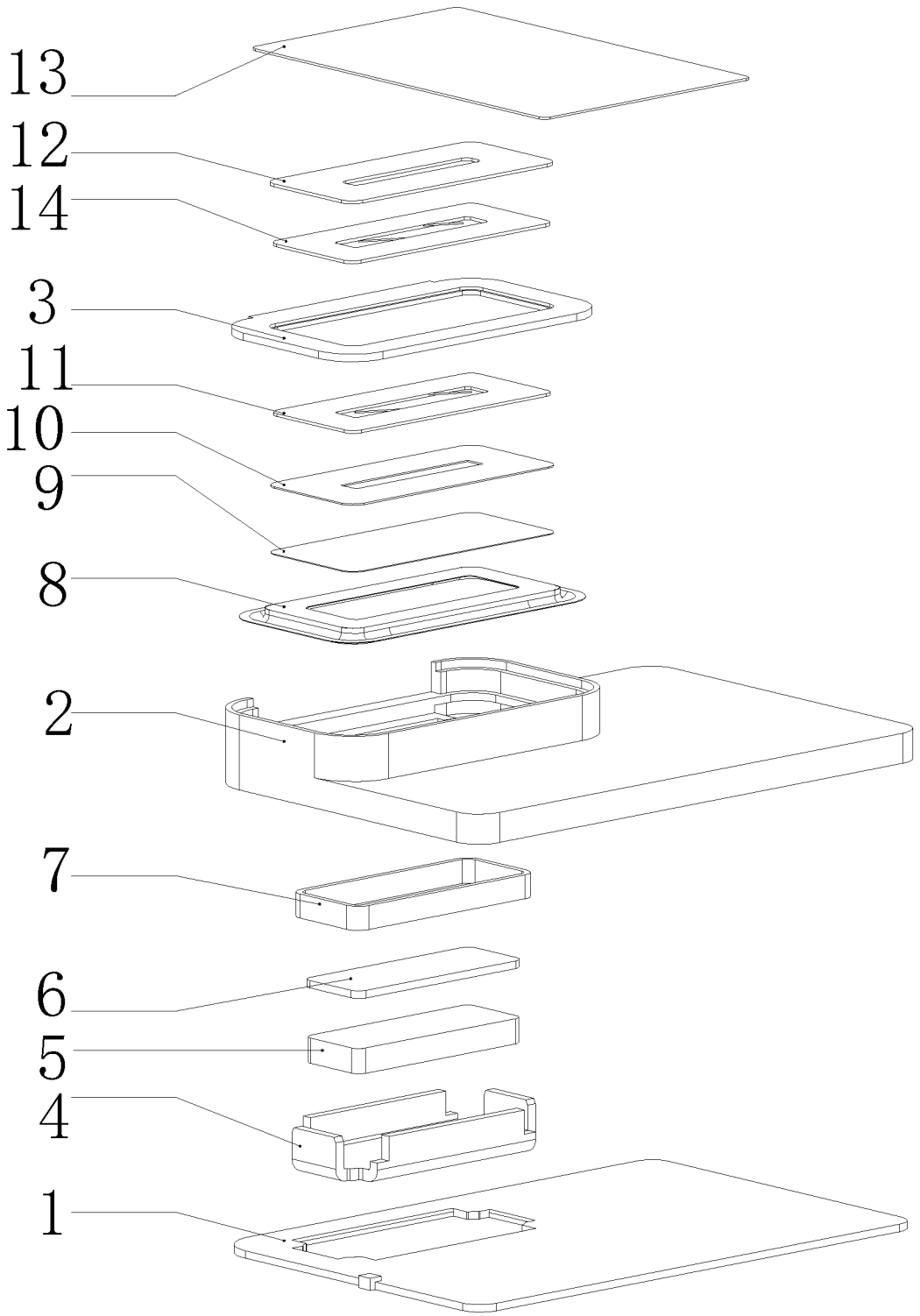
FIG. 1 is an exploded view of the speaker module of the present invention.

Various exemplary embodiments of the present invention will now be described in detail with reference to the accompanying drawings. It should be noted that the relative arrangement, numerical expressions and numerical values of the components and steps set forth in these examples do not limit the scope of the invention, unless otherwise specified.

The following description of at least one exemplary embodiment is in fact merely illustrative and is in no way intended as a limitation to the present invention and its application or use.

Techniques, methods, and apparatus known to those of ordinary skill in the relevant art may not be discussed in detail but where appropriate, the techniques, methods, and apparatus should be considered as part of the description.

Among all the examples shown and discussed herein, any specific value should be construed as merely illustrative and not as a limitation. Thus, other examples of exemplary embodiments may have different values.

It should be noted that similar reference numerals and letters denote similar items in the accompanying drawings, and therefore, once an item is defined in a drawing, and there is no need for further discussion in the subsequent accompanying drawings.

Figure 2:
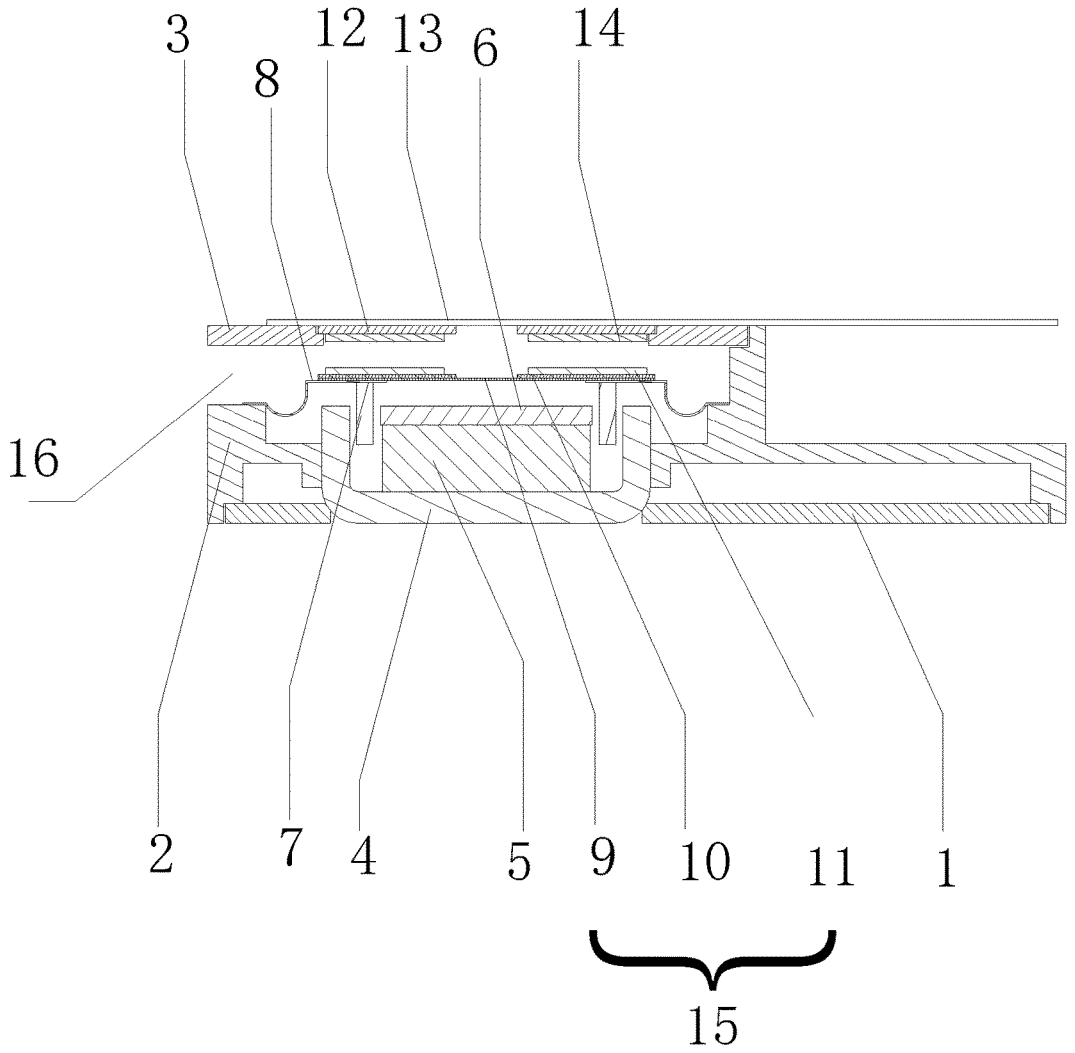
FIG. 2 is a sectional view of the speaker module of the present invention.

Referring to FIG. 1 and FIG. 2, the present invention provides a speaker module, comprising an inner cavity defined by a shell, and a speaker mounted inside the inner cavity. The speaker includes a magnetic circuit system and a vibrating system. The magnetic circuit system comprises a basin frame 4, a magnet 5, a washer 6 and the like located in the inner cavity of the shell, wherein the magnet 5 is located in the basin frame 4 and has a magnetic gap with a side wall of the basin frame 4. The vibrating system comprises a vibrating diaphragm 8 fixed inside the inner cavity of the shell and a voice coil 7 for driving the vibrating diaphragm 8 to make a sound. The voice coil 7 is fixed to a lower end of the vibrating diaphragm 8 and is suspended in the magnetic gap between the magnet 5 and the side wall of the basin frame 4. The vibrating diaphragm 8 separates the inner cavity of the shell into a front sound cavity and a rear sound cavity. A sound aperture 16 is provided to the shell in a position where the front sound cavity is located so that the sound can flow out. The rear sound cavity is an enclosed structure, which is communicated with the outside merely via a damping hole. After the voice coil 7 is energized, the voice coil 7 will vibrate under the action of the magnetic circuit system, and at the same time, the voice coil 7 drives the vibrating diaphragm 8 to vibrate together, thereby realizing the sound generation of the vibrating diaphragm 8.

In a specific embodiment of the present invention, the shell comprises an upper shell 3, an intermediate shell 2 and a lower shell 1 which are buckled together in sequence. The upper shell 3 is buckled to an upper opening of the intermediate shell 2. The lower shell 1 is buckled to a lower opening of the intermediate shell 2. The sound aperture 16 is provided to the intermediate shell 2, so that the speaker module can generate sounds from a side thereof.

In the speaker module according to the present invention, a first circuit board 9 is provided to the upper end of the vibrating diaphragm 8 and is attached thereto. The first circuit board 9 is preferably an FPCB. A first induction coil 11 is provided to an upper end of the first circuit board 9, and the voice coil 7 is electrically connected with the first induction coil 11 via a down-lead of the voice coil. In particular, the down-lead of the voice coil 7 may be connected to the first circuit board 9, and the first induction coil 11 may be connected to the first circuit board 9 via the down-lead. A second induction coil 14 is provided above the first induction coil 11 for electrically connecting a terminal device. The second induction coil 14 is electrically connected with a control circuit board for controlling the sound generation of the speaker in the terminal device, and may be fixed to the upper shell 3. Preferably, the second induction coil 14 is fixed to a lower end of a second circuit board 13 which acts as a component for electrically connecting with external members of the speaker module and which may be fixed to the outside of the upper shell 3. The upper shell 3 is provided with a through-hole through which the second induction coil 14 can reach the inner cavity, so that the second induction coil 14 can directly correspond to the first induction coil 11. The second induction coil 14 corresponds to the first induction coil 11. That is, at least part of the second induction coil 14 and the first induction coil 11 are overlapped. Of course, they may be completely overlapped, which is more preferable for those skilled in the art. In other words, the second induction coil 14 and the first induction coil 11 may face each other and are provided in parallel.

In the speaker module according to the present invention, the second induction coil 14 is electrically connected with the terminal device, and the first induction coil 11 with the voice coil 7. The terminal device conducts a current signal of an external audio to the second induction coil 14 in an operating process, so that the second induction coil 14 generates a magnetic field, which changes as the audio signal current changes. The first induction coil 11 senses the changed magnetic field; that is, when the magnetic flux flowing through a closed circuit changes, a correspondingly changing current will be generated. The changing current is conducted to the voice coil 7 so as to drive the voice coil 7 to vibrate and finally realize the sound generation of the speaker.

In the speaker module according to the present invention, through the first circuit board provided above the vibrating diaphragm, the first and second induction coils, the connection manner of traditional voice coil down-leads is changed, and much space is saved for the magnetic circuit system. That is, the magnetic circuit system can be made even larger to improve the sensitivity and the frequency response curve. According to the structure of the present invention, the down-leads of the voice coil are directly electrically connected with the first circuit board provided above the vibrating diaphragm and the first induction coil, so that the down-leads can vibrate along with the vibrating diaphragm.

In this way, a material of the down-leads of the voice coil can be selected freely. A copper-coated aluminium down-lead or the like may be used. In addition, poor polarization caused by down-leads can be avoided. Further, in the present invention, the first circuit board 9 provided at the upper end of the vibrating diaphragm, and the first induction coil 11 can act as a spherical crown structure of the vibrating diaphragm 8, thereby improving the strength of the vibrating diaphragm 8 at that position and changing the vibration frequency of the vibrating diaphragm 8. In addition, the vibrating diaphragm 8, the voice coil 7, the first circuit board 9 and the first induction coil 11 may be made into an integral structure to greatly simplify the assemble process of the speaker module.

In order to improve the magnetic flux utilization between the first induction coil 11 and the second induction coil 14, a magnetic conductive plate 10, 12 are respectively provided on end surfaces, away from each other, of the first induction coil 11 and the second induction coil 14. The magnetic conductive plate 10 is provided at the lower end of the first induction coil 11, i.e. between the first circuit board 9 and the first induction coil 11. Then, the first induction coil 11, the magnetic conductive plate 10 and the first circuit board 9 together form a spherical crown 15 of the vibrating diaphragm 8. The magnetic conductive plate 12 is provided at the upper end of the second induction coil 14, i.e. between the second circuit board 13 and the second induction coil 14. By the magnetic conductive plates 10, 12, not only the magnetic flux utilization can be improved, but also the influence of the two induction coils on other devices can be avoided. In order to improve the magnetic flux utilization rate, a magnetic conductive column or magnetic conductive liquid may be provided inside a through-hole of each of the first induction coil 11 and the second induction coil 14.

In the present invention, a through-hole may be provided to the vibrating diaphragm 8. The down-lead of the voice coil 7 may pass through the through-hole to be electrically connected with the first induction coil 11. The through-hole is preferably provided to the middle of the vibrating diaphragm 8 and is sealed by the first circuit board 9.

While certain specific embodiments of the present invention have been illustrated by way of example, it will be understood by those skilled in the art that the foregoing examples are provided for the purpose of illustration and are not intended to limit the scope of the present invention. It will be understood by those skilled in the art that the foregoing embodiments may be modified without departing from the scope and spirit of the invention. The scope of the present invention is defined by the attached claims.

What is claimed is:

1. A speaker module, comprising:

an inner cavity defined by a shell, and a magnetic circuit system and a vibrating system arranged inside the inner cavity, wherein:

the vibrating system comprises a vibrating diaphragm fixed in the inner cavity, a voice coil is fixed to the lower end of the vibrating diaphragm, a first induction coil is provided to the upper end of the vibrating diaphragm, the voice coil is electrically connected with the first induction coil via a down-lead of the voice coil, a second induction coil is provided above the first induction coil for electrically connecting a terminal device, a first circuit board is provided between the first induction coil and the vibrating diaphragm; and the shell is provided with a second circuit board to whose lower end the second induction coil is fixed.

2. The speaker module according to claim 1, wherein:

the second circuit board is fixed to the outer side of the shell, and the shell is provided with a through-hole through which the second induction coil can reach the inner cavity.

3. The speaker module according to claim 1, wherein the first induction coil faces the second induction coil.

4. The speaker module according to claim 1, wherein magnetic conductive plates are provided on end surfaces, away from each other, of the first induction coil and the second induction coil, respectively.

5. The speaker module according to claim 1, wherein the vibrating diaphragm is provided with a through-hole through which the down-lead of the voice coil is electrically connected with the first induction coil.

6. The speaker module according to claim 5, wherein the through-hole is located at the middle of the vibrating diaphragm.

7. The speaker module according to claim 1, wherein the shell comprises an upper shell, an intermediate shell and a lower shell that are buckled together in sequence.

8. The speaker module according to claim 1, wherein a magnetic conductive column or magnetic conductive liquid is provided inside a through-hole of each of the first induction coil and a through-hole of the second induction coil.

9. The speaker module according to claim 1, wherein the first circuit board is a Flexible Printed Circuit Board (FPCB).

* * * * *